US011101563B2

(12) United States Patent
Hashiguchi et al.

(10) Patent No.: US 11,101,563 B2
(45) Date of Patent: Aug. 24, 2021

(54) ANTENNA

(71) Applicant: JAPAN AVIATION ELECTRONICS INDUSTRY, LIMITED, Tokyo (JP)

(72) Inventors: Osamu Hashiguchi, Tokyo (JP); Takeshi Ebisawa, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 44 days.

(21) Appl. No.: 16/736,984

(22) Filed: Jan. 8, 2020

(65) Prior Publication Data

US 2020/0287269 A1 Sep. 10, 2020

(30) Foreign Application Priority Data

Mar. 5, 2019 (JP) ..... JP2019-039457

(51) Int. Cl.
*H01Q 1/20* (2006.01)
*H01Q 7/00* (2006.01)
(Continued)

(52) U.S. Cl.
CPC ..... *H01Q 7/00* (2013.01); *H01Q 1/12* (2013.01); *H01Q 1/36* (2013.01); *H01Q 1/38* (2013.01); *H01Q 5/364* (2015.01)

(58) Field of Classification Search
None
See application file for complete search history.

(56) References Cited

U.S. PATENT DOCUMENTS 6,950,068 B2 * 9/2005 Bordi ..... H01Q 1/243 343/700 MS
7,113,143 B2 * 9/2006 Minemura ..... H01Q 1/243 343/702
(Continued)

FOREIGN PATENT DOCUMENTS

CN 101572353 A 11/2009
CN 106299675 A 1/2017
(Continued)

OTHER PUBLICATIONS

Taiwanese Office Action (and English language translation thereof) dated Nov. 10, 2020 issued in counterpart Taiwanese Application No. 109100032.
(Continued)

*Primary Examiner* — Ab Salam Alkassim, Jr.
(74) *Attorney, Agent, or Firm* — Holtz, Holtz & Volek PC

(57) ABSTRACT

An antenna is mountable on an object. The antenna has a main portion, a facing portion, a first feed terminal, a second feed terminal and at least one reinforcing terminal. The main portion has a ring shape which includes a split line portion. The split line portion extends in a predetermined direction. The split line portion has a split, a first end portion and a second end portion. The first end portion and the second end portion are positioned away from each other in the predetermined direction with the split left therebetween. The facing portion includes a first facing portion and a second facing portion. The at least one reinforcing terminal is positioned away from the split line portion. The at least one reinforcing terminal extends from the facing portion. The at least one reinforcing terminal is fixed to the object when the antenna is mounted on the object.

12 Claims, 8 Drawing Sheets

(51) Int. Cl.

| | |
|---|---|
| ***H01Q 1/12*** | (2006.01) |
| ***H01Q 1/36*** | (2006.01) |
| ***H01Q 1/38*** | (2006.01) |
| *H01Q 5/364* | (2015.01) |

(56) References Cited

U.S. PATENT DOCUMENTS

| | | | | |
|---|---|---|---|---|
| 7,518,567 | B2 | 4/2009 | Utagawa et al. | |
| 8,063,828 | B2 | 11/2011 | Xu et al. | |
| 8,884,836 | B2 | 11/2014 | Kim et al. | |
| 9,502,761 | B2 | 11/2016 | Itoh et al. | |
| 9,806,418 | B2 * | 10/2017 | Lin | H01Q 5/378 |
| 10,205,221 | B2 | 2/2019 | Fan et al. | |
| 10,811,755 | B2 * | 10/2020 | Su | H01P 1/20336 |
| 2006/0290569 | A1 | 12/2006 | Boyle | |
| 2009/0096545 | A1 * | 4/2009 | O'Hara | H01P 7/08 332/129 |
| 2010/0033381 | A1 | 2/2010 | Liu et al. | |
| 2010/0265146 | A1 * | 10/2010 | Montgomery | H01Q 1/38 343/722 |
| 2012/0146875 | A1 | 6/2012 | Ali et al. | |
| 2014/0203987 | A1 | 7/2014 | Itoh et al. | |
| 2015/0288071 | A1 * | 10/2015 | Toyao | H01Q 5/328 343/700 MS |
| 2016/0134018 | A1 | 5/2016 | Wu | |
| 2016/0294048 | A1 * | 10/2016 | Xu | H01Q 1/48 |
| 2017/0194717 | A1 | 7/2017 | Kosaka et al. | |
| 2017/0294952 | A1 * | 10/2017 | Uchida | H01Q 9/42 |
| 2018/0123261 | A1 * | 5/2018 | Sano | H01Q 21/0087 |
| 2020/0220269 | A1 * | 7/2020 | Matsuura | H01Q 9/045 |
| 2020/0287276 | A1 * | 9/2020 | Hashiguchi | H01Q 1/50 |
| 2020/0335849 | A1 * | 10/2020 | Hashiguchi | H01Q 1/36 |
| 2020/0335868 | A1 * | 10/2020 | Hashiguchi | H01Q 7/00 |
| 2020/0411975 | A1 * | 12/2020 | Hashiguchi | H01Q 1/38 |
| 2020/0412024 | A1 * | 12/2020 | Hashiguchi | H01Q 23/00 |
| 2021/0075117 | A1 * | 3/2021 | Hankui | H01Q 3/01 |

FOREIGN PATENT DOCUMENTS

| | | | |
|---|---|---|---|
| CN | 206349509 | U | 7/2017 |
| CN | 207938801 | U | 10/2018 |
| EP | 1313165 | A2 | 5/2003 |
| EP | 2242144 | A2 | 10/2010 |
| EP | 3001503 | A1 | 3/2016 |
| JP | 2007221774 | A | 8/2007 |
| JP | 2016225956 | A | 12/2016 |
| JP | 2018174585 | A | 11/2018 |
| TW | M368906 | U | 11/2009 |
| WO | 2018089947 | A1 | 5/2018 |

OTHER PUBLICATIONS

European Office Action dated Mar. 18, 2021 issued in counterpart European Application No. 20150935.3.

Extended European Search Report (EESR) dated Jul. 14, 2020 issued European Application No. 20150935.3.

Chinese Office Action (and English language translation thereof) dated Apr. 26, 2021 issued in counterpart Chinese Application No. 202010052370.5.

* cited by examiner

ANTENNA

CROSS REFERENCE TO RELATED APPLICATIONS

This application is based on and claims priority under 35 U.S.C. § 119 to Japanese Patent Application No. JP2019-039457 filed Mar. 5, 2019, the contents of which are incorporated herein in their entireties by reference.

BACKGROUND OF THE INVENTION

This invention relates to an antenna which is mountable on an object.

JPA2016-225956 (Patent Document 1) discloses an antenna 900 of this type. As understood from FIGS. 15 and 16, the antenna 900 of Patent Document 1 is printed on a printed circuit board (object) 910.

The antenna 900 of Patent Document 1 might have variation in antenna characteristics due to manufacturing variation of the printed circuit board 910.

SUMMARY OF THE INVENTION

It is therefore an object of the present invention to provide an antenna which is mountable on an object and which has little variation in antenna characteristics.

If an antenna is formed as a discrete member which is distinct and separated from an object, the antenna consists of a main portion and a facing portion, wherein the main portion is provided with a feed terminal, and the facing portion is held by the main portion while constituting a capacitor of the antenna.

In order that the antenna formed as the discrete member has a certain amount of capacitance, the facing portion is required to protrude from the main portion. If a user applies an external force to the facing portion under a state where the antenna is mounted on the object, the facing portion might be deformed so that capacitance of the antenna is changed.

The present inventors have found that, if the antenna formed as the discrete member is provided with a reinforcing terminal at the facing portion, the facing portion is prevented from being deformed when an external force is applied to the facing portion under the state where the antenna is mounted on the object. The present invention is based on the aforementioned finding.

One aspect of the present invention provides an antenna mountable on an object. The antenna has a main portion, a facing portion, a first feed terminal, a second feed terminal and at least one reinforcing terminal. The main portion has a ring shape which includes a split line portion. The split line portion extends in a predetermined direction. The split line portion has a split, a first end portion and a second end portion. The first end portion and the second end portion are positioned away from each other in the predetermined direction with the split left therebetween. The facing portion includes a first facing portion and a second facing portion. The first facing portion is provided on the first end portion. The second facing portion is provided on the second end portion. The first facing portion and the second facing portion are spaced away from each other and face each other. Each of the first feed terminal and the second feed terminal is provided on the main portion. Each of the first feed terminal and the second feed terminal is fixed to the object when the antenna is mounted on the object. The at least one reinforcing terminal is positioned away from the split line portion. The at least one reinforcing terminal extends from the facing portion. The at least one reinforcing terminal is fixed to the object when the antenna is mounted on the object.

The antenna of the present invention is configured as follows: the antenna has the at least one reinforcing terminal; the at least one reinforcing terminal extends from the facing portion; the at least one reinforcing terminal is fixed to the object when the antenna is mounted on the object; and the at least one reinforcing terminal is positioned away from the split line portion. This configuration prevents deformation of the facing portion even if an external force is applied to the facing portion under a state where the antenna is mounted on the object. Thus, the antenna of the present invention has little variation in antenna characteristics.

An appreciation of the objectives of the present invention and a more complete understanding of its structure may be had by studying the following description of the preferred embodiment and by referring to the accompanying drawings.

Figure 1:
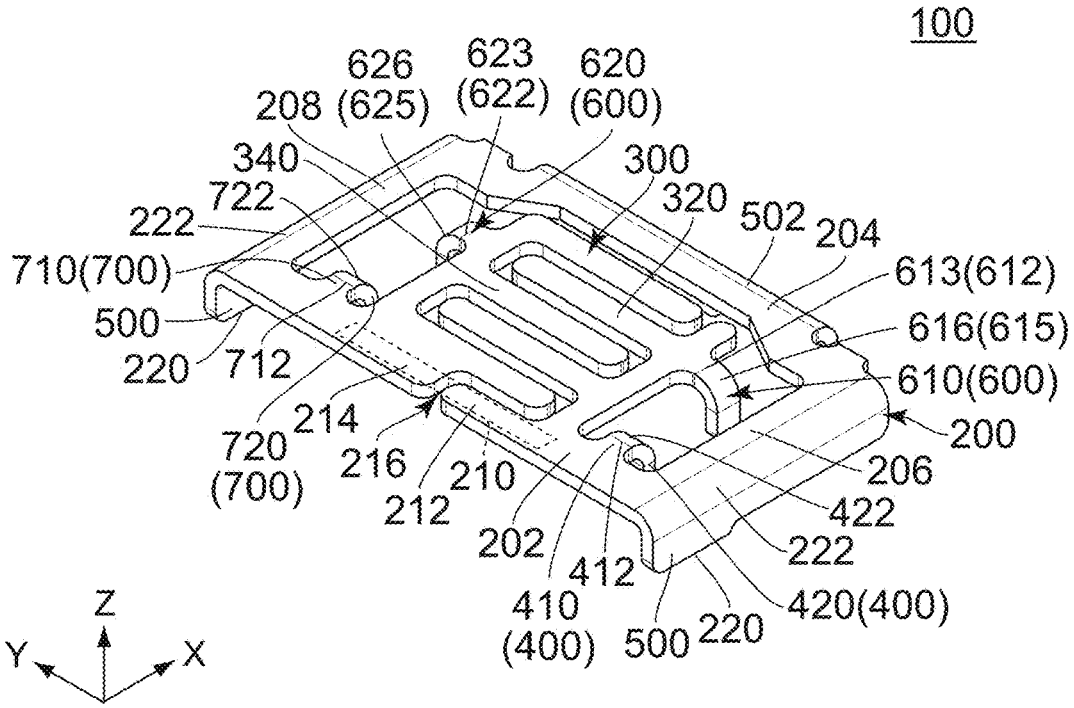
FIG. 1 is a perspective view showing an antenna according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 5:
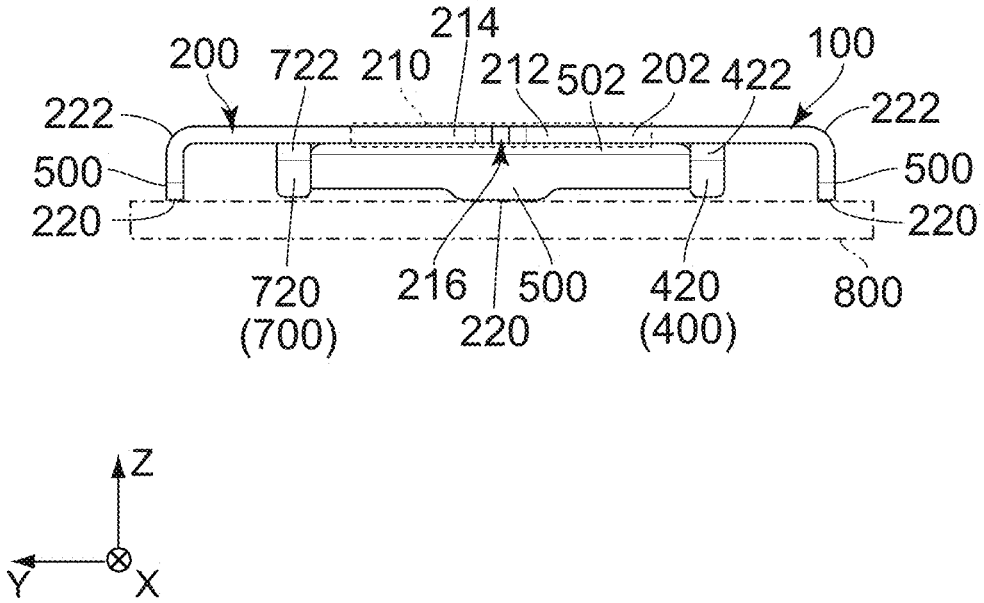
FIG. 5 is a front view showing the antenna of FIG. 1. In the figure, an object is illustrated by dotted line.

As shown in FIG. 5, an antenna 100 according to a first embodiment of the present invention is mountable on an object 800. The object 800 of the present embodiment is, for example, a printed circuit board. The object 800 has an antenna mounting surface (not shown). The antenna mounting surface is formed with a plurality of connecting pads (not shown). The object 800 further comprises a feed line (not shown) and a ground plane (not shown).

Figure 3:
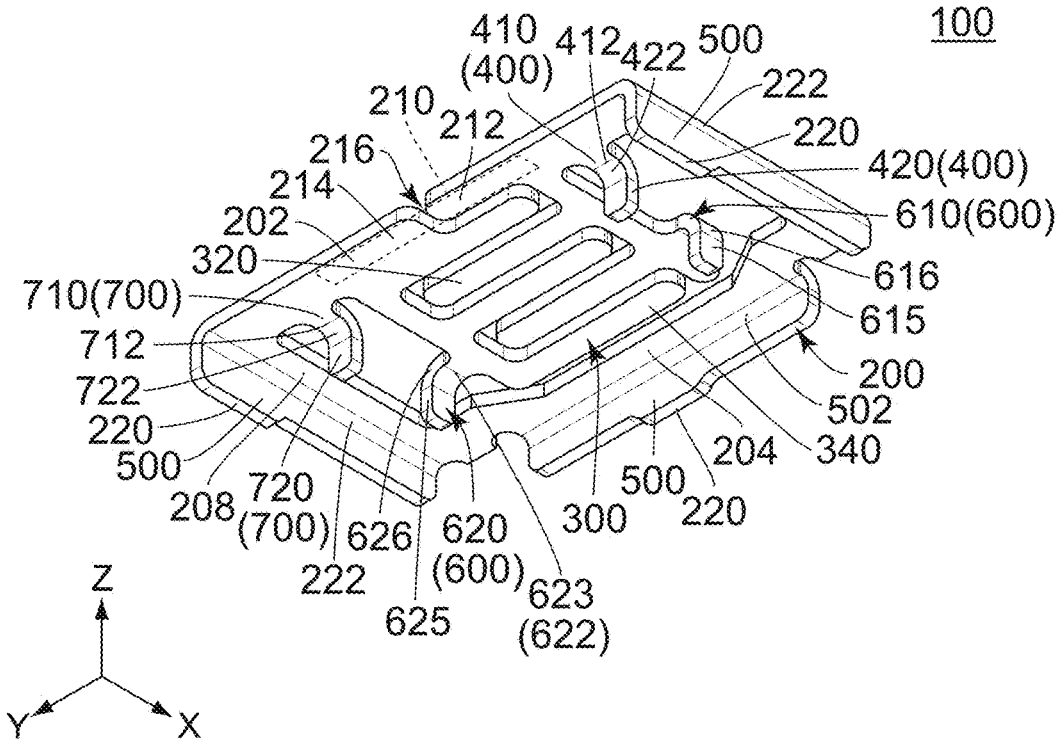
FIG. 3 is another perspective view showing the antenna of FIG. 1.
Figure 4:
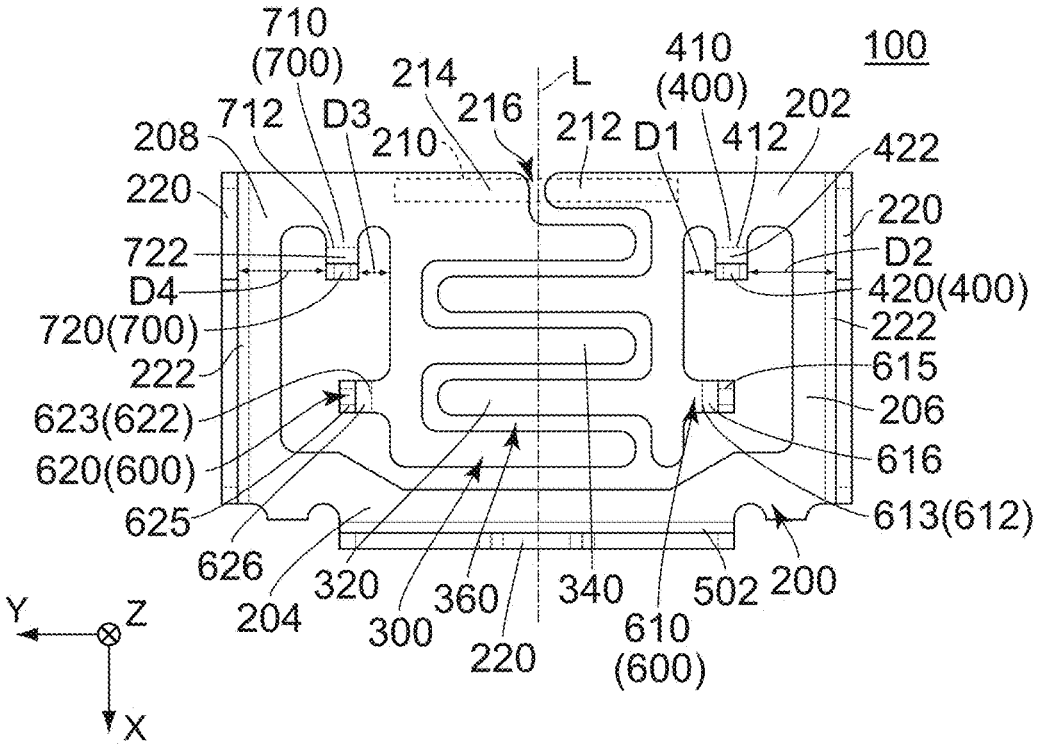
FIG. 4 is a bottom view showing the antenna of FIG. 1.

Referring to FIGS. 3 and 4, the antenna 100 of the present embodiment is formed from a single metal plate which has a plurality of bent portions 222, 422, 502, 616, 626 and 722. The antenna 100 of the present embodiment forms a split ring resonator. Specifically, the antenna 100 is a discrete member which is formed by punching out a single metal plate, followed by bending it. More specifically, the antenna 100 of the present embodiment has a main portion 200, a facing portion 300, a first feed terminal 400, three second feed terminals 500 and two reinforcing terminals 600. However, the present invention is not limited thereto. The number of the second feed terminal 500 may be one or more. Similarly, the number of the reinforcing terminal 600 may be one or more.

Figure 2:
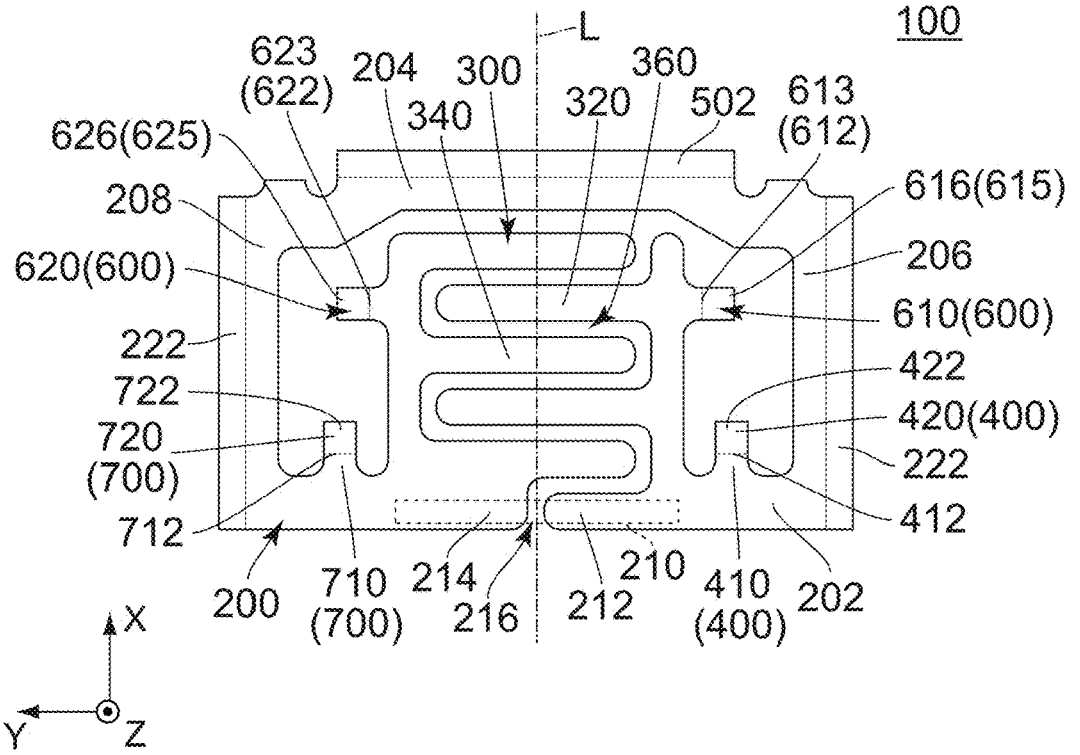
FIG. 2 is a top view showing the antenna of FIG. 1.

Referring to FIG. 2, the main portion 200 of the present embodiment constitutes an inductance of the antenna 100. The main portion 200 has a substantially rectangular ring shape with four sides 202, 204, 206 and 208. The wording "ring shape" as used herein includes not only an annular shape but also an elliptical annular shape and a polygonal annular shape. The sides 202 and 204 define opposite ends, respectively, of the main portion 200 in a front-rear direction. More specifically, in the front-rear direction, the side 202 defines a front end of the main portion 200 while the side 204 defines a rear end of the main portion 200. In the present embodiment, the front-rear direction is an X-direction. Specifically, forward is a negative X-direction while rearward is a positive X-direction. The sides 206 and 208 define opposite ends, respectively, of the main portion 200 in a right-left direction. More specifically, in the right-left direction, the side 206 defines a left end of the main portion 200 while the side 208 defines a right end of the main portion 200. In the present embodiment, the right-left direction is a Y-direction. Specifically, rightward is a positive Y-direction while leftward is a negative Y-direction. Referring to FIGS. 4 to 7, when the antenna 100 is mounted on the object 800, outer edges of the three sides 204, 206 and 208 of the main portion 200 are fixed to the object 800. Dissimilarly, when the antenna 100 is mounted on the object 800, an outer edge, or a front edge, of the side 202 of the main portion 200 are not fixed to the object 800.

As shown in FIG. 4, the main portion 200 of the present embodiment is provided with a plurality of fixed portions 220. The fixed portions 220 are arranged to be mirror images of one another with respect to the facing portion 300. In other words, the arrangement of the fixed portions 220 is symmetrical with respect to the facing portion 300. More specifically, the main portion 200 is provided with three of the fixed portions 220, and the fixed portions 220 are arranged to be mirror images of one another with respect to an imaginary line L which is parallel to the front-rear direction and passes through a center of the facing portion 300 in the right-left direction. However, the present invention is not limited thereto. The fixed portions 220 may be arranged not to be mirror images of one another with respect to the facing portion 300. If the fixed portions 220 are arranged to be mirror images of one another with respect to the facing portion 300, the antenna 100 has an advantage as follows: when an accidental external force is applied to the antenna 100, the applied external force is appropriately distributed to the fixed portions 220 so that the antenna 100 is prevented from being deformed. Accordingly, it is preferable that the arrangement of the fixed portions 220 is symmetrical with respect to the facing portion 300. As shown in FIGS. 1 and 3, each of the fixed portions 220 is a lower end of the antenna 100 in an up-down direction. In the present embodiment, the up-down direction is a Z-direction. Specifically, upward is a positive Z-direction while downward is a negative Z-direction.

As shown in FIG. 2, the main portion 200 of the present embodiment is provided with a split line portion 210 which has a split 216. More specifically, the split line portion 210 is provided on a specific side 202 of the four sides 202, 204, 206 and 208 of the main portion 200. In other words, the main portion 200 has the ring shape which includes the split line portion 210, and the split line portion 210 has the split 216.

As shown in FIG. 2, the split line portion 210 is positioned at a front end of the antenna 100 in the front-rear direction. The split line portion 210 extends in a predetermined direction. The split line portion 210 has a first end portion 212 and a second end portion 214. The first end portion 212 and the second end portion 214 are positioned away from each other in the predetermined direction with the split 216 left therebetween. In the present embodiment, the predetermined direction is the Y-direction. Specifically, in the present embodiment, the predetermined direction is also the right-left direction. However, the present invention is not limited thereto. The predetermined direction may be an arc direction which is arched in the front-rear direction.

As shown in FIG. 2, in the predetermined direction, the first end portion 212 and the second end portion 214 of the present embodiment face each other across the split 216 therebetween. Each of the first end portion 212 and the second end portion 214 is positioned around the imaginary line L. The first end portion 212 is positioned left of the second end portion 214 in the right-left direction.

As shown in FIG. 2, the split 216 of the present embodiment is a slit extending in the front-rear direction. The split 216 is positioned at a position same as a position of the imaginary line L in the predetermined direction.

Referring to FIG. 2, the facing portion 300 of the present embodiment constitutes a capacitor of the antenna 100. Since the main portion 200 constitutes the inductance of the antenna 100 as described above, the facing portion 300 and the main portion 200 form an LC resonator circuit. A rear end of the facing portion 300 is not coupled with the main portion 200. The facing portion 300 is positioned between the sides 202 and 204 of the main portion 200 in the front-rear direction. The facing portion 300 is positioned between the sides 206 and 208 of the main portion 200 in the right-left direction. The facing portion 300 includes a first facing portion 320 and a second facing portion 340. Specifically, the first facing portion 320 is provided on the first end portion 212, and the second facing portion 340 is provided on the second end portion 214.

As shown in FIG. 2, the first facing portion 320 and the second facing portion 340 of the present embodiment are spaced away from each other and face each other. More specifically, in the right-left direction, the first facing portion 320 and the second facing portion 340 are spaced away from each other and face each other. The facing portion 300 is formed with an interdigital slot 360 between the first facing portion 320 and the second facing portion 340.

As shown in FIG. 2, the first facing portion 320 of the present embodiment has a comb shape. The first facing portion 320 extends from the first end portion 212 to be positioned inward of the main portion 200. More specifically, the first facing portion 320 extends rearward in the front-rear direction from the first end portion 212 to be positioned inward of the main portion 200. A rear end of the first facing portion 320 is not coupled with the main portion 200. The first facing portion 320 is positioned left of the second facing portion 340 in the right-left direction.

As shown in FIG. 2, the second facing portion 340 of the present embodiment has a comb shape. The second facing portion 340 extends from the second end portion 214 to be positioned inward of the main portion 200. More specifically, the second facing portion 340 extends rearward in the front-rear direction from the second end portion 214 to be positioned inward of the main portion 200. A rear end of the second facing portion 340 is not coupled with the main portion 200. The second facing portion 340 is positioned right of the first facing portion 320 in the right-left direction.

As shown in FIG. 5, the first feed terminal 400 of the present embodiment is fixed to the object 800 when the antenna 100 is mounted on the object 800. More specifically, the first feed terminal 400 is electrically connected to the feed line (not shown) through the connecting pad (not shown) of the object 800 when the antenna 100 is mounted on the object 800.

As shown in FIG. 2, the first feed terminal 400 is provided on the main portion 200. In detail, the first feed terminal 400 is provided on the specific side 202, on which the split line portion 210 is provided, of the four sides 202, 204, 206, and 208 of the main portion 200. Specifically, the first feed terminal 400 extends from the specific side 202 of the four sides 202, 204, 206 and 208 of the main portion 200.

As shown in FIG. 4, on the main portion 200, the first feed terminal 400 is positioned between the first end portion 212 and any of the second feed terminals 500. On the main portion 200, the first feed terminal 400 is nearer to the first end portion 212 than to any of the second feed terminals 500. In other words, the first feed terminal 400 is provided on the main portion 200 so that a current path between the first feed terminal 400 and the first end portion 212 is shorter than a current path between the first feed terminal 400 and any of the second feed terminals 500. The first feed terminal 400 is positioned away from any of the first end portion 212 and the first facing portion 320. More specifically, the first feed terminal 400 is positioned leftwardly away from any of the first end portion 212 and the first facing portion 320 in the right-left direction.

As shown in FIG. 4, a shortest distance D1 between the first feed terminal 400 and the first facing portion 320 is shorter than a shortest distance D2 between the first feed terminal 400 and any of the second feed terminals 500.

As shown in FIGS. 2 and 3, the first feed terminal 400 of the present embodiment has a first portion 410 and a second portion 420.

As shown in FIGS. 2 and 3, the first portion 410 of the present embodiment extends in an inward direction, which is directed inward of the main portion 200 and intersects with the predetermined direction, from the main portion 200. In the present embodiment, the inward direction is a positive X-direction, or rearward. Specifically, the first portion 410 extends rearward in the front-rear direction from the main portion 200. The first portion 410 has an end 412 in the inward direction. The end 412 of the first portion 410 is a rear end of the first portion 410.

As shown in FIG. 5, the second portion 420 of the present embodiment is fixed to the object 800 when the antenna 100 is mounted on the object 800. As shown in FIG. 3, the second portion 420 extends in an intersecting direction, which intersects with both the inward direction and the predetermined direction, from the end 412 of the first portion 410. In the present embodiment, the intersecting direction is a Z-direction. In other words, the intersecting direction of the present embodiment is also the up-down direction. However, the present invention is not limited thereto. The intersecting direction may be modified, provided that the intersecting direction intersects with both the inward direction and the predetermined direction. The second portion 420 extends downward in the up-down direction. The second portion 420 has a first feed terminal bent portion (bent portion) 422 at its upper end in the up-down direction. As shown in FIG. 4, the first feed terminal bent portion 422 of the second portion 420 is coupled with the end 412 of the first portion 410 in the front-rear direction.

Figure 7:
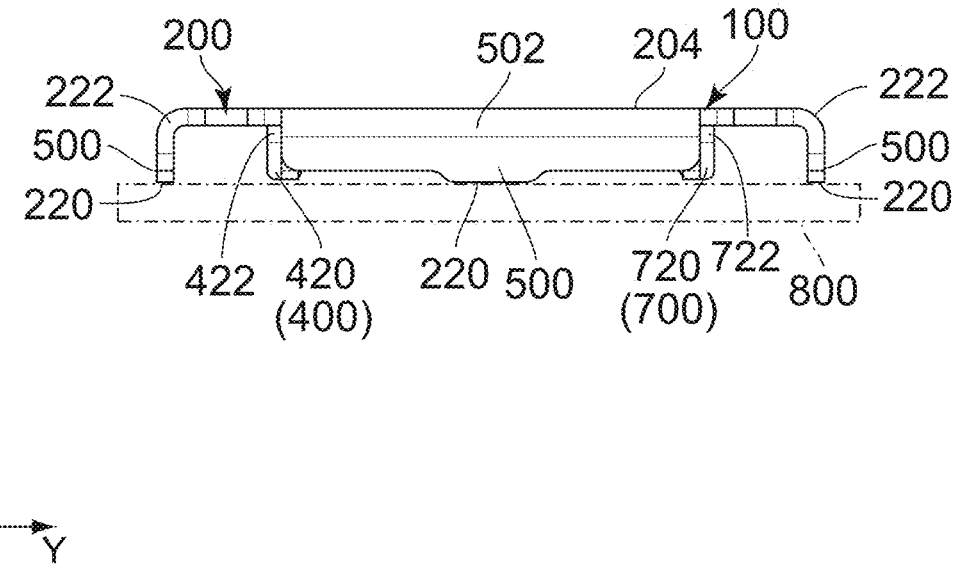
FIG. 7 is a rear view showing the antenna of FIG. 1. In the figure, the object is illustrated by dotted line.

As shown in FIG. 7, the second feed terminal 500 of the present embodiment is fixed to the object 800 when the antenna 100 is mounted on the object 800. More specifically, the second feed terminal 500 is electrically connected to the ground plane (not shown) through both the connecting pad (not shown) of the object 800 and the fixed portion 220 when the antenna 100 is mounted on the object 800.

As shown in FIGS. 3 and 4, each of the second feed terminals 500 of the present embodiment is provided on the main portion 200. More specifically, the second feed terminals 500 are provided on the sides 204, 206 and 208, respectively, of the four sides 202, 204, 206 and 208 of the main portion 200. Each of the second feed terminals 500 extends downward in the up-down direction from the main portion 200. Each of two of the second feed terminals 500 has a bent portion 222 at its upper end in the up-down direction. A remaining one of the second feed terminals 500 has a bent portion 502 at its upper end in the up-down direction. The bent portion 502 of the remaining one of the second feed terminals 500 is coupled with the side 204 of the main portion 200. The bent portions 222 of the two second feed terminals 500 are coupled with the sides 206 and 208, respectively, of the main portion 200.

Figure 6:
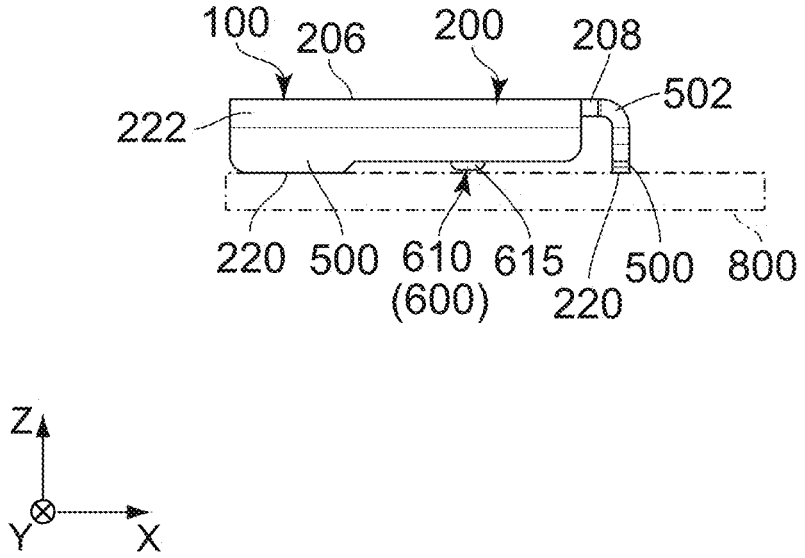
FIG. 6 is a side view showing the antenna of FIG. 1. In the figure, the object is illustrated by dotted line.

As shown in FIG. 6, each of the reinforcing terminals 600 of the present embodiment is fixed to the object 800 when the antenna 100 is mounted on the object 800. As shown in FIG. 3, each of the reinforcing terminals 600 extends from the facing portion 300.

As shown in FIG. 4, the reinforcing terminal 600 is positioned away from the split line portion 210. More specifically, the reinforcing terminal 600 is positioned rearwadly away from the split line portion 210 in the front-rear direction. The reinforcing terminal 600 is positioned away from any of the first end portion 212 and the second end portion 214. More specifically, the reinforcing terminal 600 is positioned rearwardly away from any of the first end portion 212 and the second end portion 214 in the front-rear direction. The reinforcing terminal 600 is positioned away from the first feed terminal 400. More specifically, the reinforcing terminal 600 is positioned rearwardly away from the first feed terminal 400 in the front-rear direction.

As shown in FIG. 4, the reinforcing terminal 600 is nearer to the rear end of the facing portion 300 than to the split line portion 210 in the front-rear direction. The reinforcing terminal 600 is nearer to the rear end of the facing portion 300 than to any of the first end portion 212 and the second end portion 214 in the front-rear direction. The reinforcing terminal 600 is nearer to the rear end of the facing portion 300 than to the first feed terminal 400 in the front-rear direction. Specifically, the reinforcing terminal 600 is positioned around the rear end of the facing portion 300.

As shown in FIG. 4, the reinforcing terminal 600 is nearer to the side 204 of the main portion 200 than to the split line portion 210 in the front-rear direction. The reinforcing terminal 600 is nearer to the side 204 of the main portion 200 than to any of the first end portion 212 and the second end portion 214 in the front-rear direction. The reinforcing terminal 600 is nearer to the side 204 of the main portion 200 than to the first feed terminal 400 in the front-rear direction.

As shown in FIG. 3, the reinforcing terminals 600 of the present embodiment include a first reinforcing terminal 610 and a second reinforcing terminal 620.

As shown in FIG. 3, the first reinforcing terminal 610 of the present embodiment extends from the first facing portion 320. More specifically, the first reinforcing terminal 610 extends leftward from the first facing portion 320 and is then bent to extend downward. The first reinforcing terminal 610 is positioned left of the second reinforcing terminal 620 in the right-left direction.

As shown in FIG. 4, the first reinforcing terminal 610 is positioned away from the split line portion 210. More specifically, the first reinforcing terminal 610 is positioned rearwardly away from the split line portion 210 in the front-rear direction. The first reinforcing terminal 610 is positioned away from the first end portion 212. More specifically, the first reinforcing terminal 610 is positioned rearwardly away from the first end portion 212 in the front-rear direction. The first reinforcing terminal 610 is positioned away from the first feed terminal 400. More specifically, the first reinforcing terminal 610 is positioned rearwardly away from the first feed terminal 400 in the front-rear direction.

As shown in FIG. 4, the first reinforcing terminal 610 is nearer to the rear end of the first facing portion 320 than to the split line portion 210 in the front-rear direction. The first reinforcing terminal 610 is nearer to the rear end of the first facing portion 320 than to the first end portion 212 in the front-rear direction. The first reinforcing terminal 610 is nearer to the rear end of the first facing portion 320 than to the first feed terminal 400 in the front-rear direction. Specifically, the first reinforcing terminal 610 is positioned around the rear end of the first facing portion 320.

As shown in FIG. 4, the first reinforcing terminal 610 is nearer to the side 204 of the main portion 200 than to the split line portion 210 in the front-rear direction. The first reinforcing terminal 610 is nearer to the side 204 of the main portion 200 than to the first end portion 212 in the front-rear direction. The first reinforcing terminal 610 is nearer to the side 204 of the main portion 200 than to the first feed terminal 400 in the front-rear direction.

As shown in FIG. 4, the first reinforcing terminal 610 of the present embodiment has a first connecting portion 612 and a second connecting portion 615.

As shown in FIG. 4, the first connecting portion 612 of the present embodiment extends in a first outward direction, which is directed outward of the first facing portion 320 and intersects with the front-rear direction, from the first facing portion 320. More specifically, the first connecting portion 612 extends leftward in the right-left direction from the first facing portion 320. The first connecting portion 612 has an end 613 in the first outward direction. The end 613 of the first connecting portion 612 is a left end of the first connecting portion 612.

As shown in FIG. 6, the second connecting portion 615 is fixed to the object 800 when the antenna 100 is mounted on the object 800. As shown in FIGS. 3 and 4, the second connecting portion 615 extends in a direction, which intersects with both the first outward direction and the front-rear direction, from the end 613 of the first connecting portion 612. More specifically, the second connecting portion 615 extends downward in the up-down direction. As shown in FIG. 1, the second connecting portion 615 has a first reinforcing terminal bent portion (bent portion) 616 at its upper end in the up-down direction. The first reinforcing terminal bent portion 616 of the second connecting portion 615 is coupled with the end 613 of the first connecting portion 612.

As described above, the first reinforcing terminal 610 extends downward from the first facing portion 320. With this structure, if an external force is applied to the first facing portion 320 from above under a state where the antenna 100 is mounted on the object 800, the applied external force is received by the object 800 through the first reinforcing terminal 610. Accordingly, the first facing portion 320 is effectively prevented from being deformed.

As shown in FIG. 3, the second reinforcing terminal 620 of the present embodiment extends from the second facing portion 340. More specifically, the second reinforcing terminal 620 extends rightward from the second facing portion 340 and is then bent to extend downward. The second reinforcing terminal 620 is positioned right of the first reinforcing terminal 610 in the right-left direction.

As shown in FIG. 4, the second reinforcing terminal 620 is positioned away from the split line portion 210. More specifically, the second reinforcing terminal 620 is positioned rearwardly away from the split line portion 210 in the front-rear direction. The second reinforcing terminal 620 is positioned away from the second end portion 214. More specifically, the second reinforcing terminal 620 is positioned reawardly away from the second end portion 214 in the front-rear direction.

As shown in FIG. 4, the second reinforcing terminal 620 is nearer to the rear end of the second facing portion 340 than to the split line portion 210 in the front-rear direction. The second reinforcing terminal 620 is nearer to the rear end of the second facing portion 340 than to the second end portion 214 in the front-rear direction. Specifically, the second reinforcing terminal 620 is positioned around the rear end of the second facing portion 340.

As shown in FIG. 4, the second reinforcing terminal 620 is nearer to the side 204 of the main portion 200 than to the split line portion 210 in the front-rear direction. The second reinforcing terminal 620 is nearer to the side 204 of the main portion 200 than to the second end portion 214 in the front-rear direction.

As shown in FIG. 4, the second reinforcing terminal 620 of the present embodiment has a first connecting portion 622 and a second connecting portion 625.

As shown in FIG. 4, the first connecting portion 622 of the present embodiment extends in a second outward direction, which is directed outward of the second facing portion 340 and intersects with the front-rear direction, from the second facing portion 340. More specifically, the first connecting portion 622 extends rightward in the right-left direction. The first connecting portion 622 has an end 623 in the second outward direction. The end 623 of the first connecting portion 622 is a right end of the first connecting portion 622.

Referring to FIGS. 3 and 6, the second connecting portion 625 of the present embodiment is fixed to the object 800 when the antenna 100 is mounted on the object 800. As shown in FIG. 3, the second connecting portion 625 extends in a direction, which intersects with both the second outward direction and the front-rear direction, from the end 623 of the first connecting portion 622. More specifically, the second connecting portion 625 extends downward in the up-down direction. The second connecting portion 625 has a second reinforcing terminal bent portion (bent portion) 626 at its upper end in the up-down direction. The second reinforcing terminal bent portion 626 of the second connecting portion 625 is coupled with the end 623 of the first connecting portion 622.

As described above, the second reinforcing terminal 620 extends downward from the second facing portion 340. With this structure, if an external force is applied to the second facing portion 340 from above under the state where the antenna 100 is mounted on the object 800, the applied external force is received by the object 800 through the second reinforcing terminal 620. Accordingly, the second facing portion 340 is effectively prevented from being deformed.

As shown in FIGS. 2 to 4, the antenna 100 of the present embodiment further comprises an additional terminal 700.

As shown in FIG. 5, the additional terminal 700 of the present embodiment is fixed to the object 800 when the antenna 100 is mounted on the object 800. When the additional terminal 700 is fixed to the object 800, the additional terminal 700 is not connected to any of the feed line and the ground plane of the object 800.

As shown in FIG. 2, the additional terminal 700 is provided on the main portion 200. More specifically, the additional terminal 700 is provided on the specific side 202, on which the split line portion 210 is provided, of the four sides 202, 204, 206 and 208 of the main portion 200. Specifically, the additional terminal 700 extends from the specific side 202 of the four sides 202, 204, 206 and 208 of the main portion 200.

As shown in FIG. 4, on the main portion 200, the additional terminal 700 is positioned between the second end portion 214 and any of the second feed terminals 500. On the main portion 200, the additional terminal 700 is nearer to the second end portion 214 than to any of the second feed terminals 500. The additional terminal 700 is positioned opposite the first feed terminal 400 across the facing portion 300. The additional terminal 700 is positioned to be a mirror image of the first feed terminal 400 with respect to the facing portion 300. The additional terminal 700 is positioned to be a mirror image of to the first feed terminal 400 with respect to the imaginary line L. However, the present invention is not limited thereto. The additional terminal 700 may be positioned not to be a mirror image of the first feed terminal 400 with respect to the facing portion 300. Similarly, the additional terminal 700 may be positioned not to be a mirror image of the first feed terminal 400 with respect to the imaginary line L. The additional terminal 700 is positioned away from any of the second end portion 214 and the second facing portion 340. More specifically, the additional terminal 700 is positioned rightwardly away from any of the second end portion 214 and the second facing portion 340 in the right-left direction.

As shown in FIG. 4, a shortest distance D3 between the additional terminal 700 and the second facing portion 340 is shorter than a shortest distance D4 between the additional terminal 700 and any of the second feed terminals 500.

As shown in FIG. 4, the additional terminal 700 is positioned away from the reinforcing terminal 600. More specifically, the additional terminal 700 is positioned forwardly away from the reinforcing terminal 600 in the front-rear direction. The additional terminal 700 is farther away from the rear end of the facing portion 300 than the reinforcing terminal 600 in the front-rear direction. The additional terminal 700 is farther away from the rear end of the second facing portion 340 than the second reinforcing terminal 620 in the front-rear direction. The additional terminal 700 is farther away from the side 204 of the main portion 200 than the reinforcing terminal 600 in the front-rear direction. The additional terminal 700 is farther away from the side 204 of the main portion 200 than the second reinforcing terminal 620 in the front-rear direction.

As shown in FIGS. 2 and 3, the additional terminal 700 has a structure same as that of the first feed terminal 400. More specifically, the additional terminal 700 has a first portion 710 and a second portion 720.

As shown in FIGS. 2 and 3, the first portion 710 of the present embodiment extends in the inward direction, which is directed inward of the main portion 200 and intersects with the predetermined direction, from the main portion 200. More specifically, the first portion 710 extends rearward in the front-rear direction from the main portion 200. The first portion 710 has an end 712 in the inward direction. The end 712 of the first portion 710 is a rear end of the first portion 710.

As shown in FIG. 5, the second portion 720 of the present embodiment is fixed to the object 800 when the antenna 100 is mounted on the object 800. As shown in FIG. 3, the second portion 720 extends in the intersecting direction, which intersects with both the inward direction and the predetermined direction, from the end 712 of the first portion 710. More specifically, the second portion 720 extends downward in the up-down direction. The second portion 720 has an additional terminal bent portion (bent portion) 722 at its upper end in the up-down direction. As shown in FIG. 4, the additional terminal bent portion 722 of the second portion 720 is coupled with the end 712 of the first portion 710 in the front-rear direction.

Second Embodiment

Figure 11:
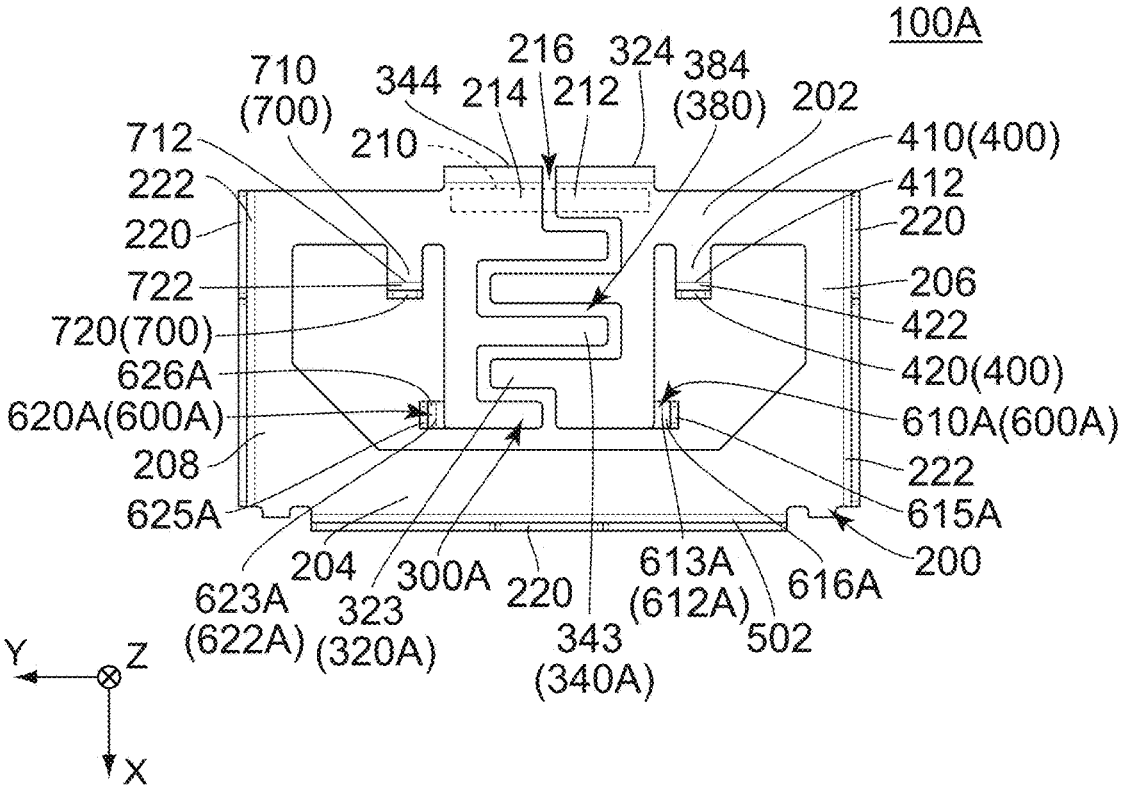
FIG. 11 is a bottom view showing the antenna of FIG. 8.
Figure 12:
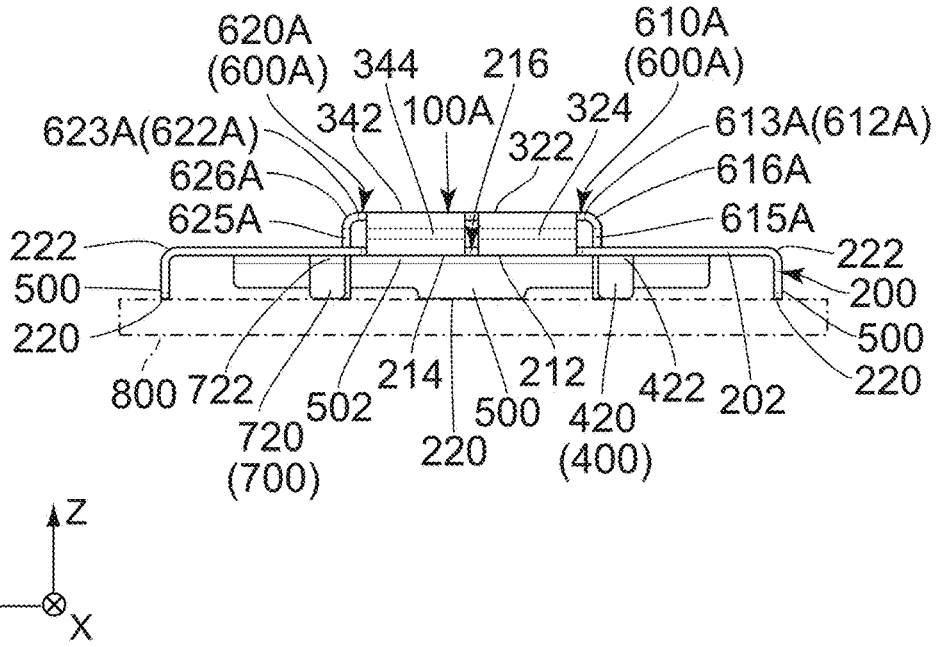
FIG. 12 is a front view showing the antenna of FIG. 8. In the figure, an object is illustrated by dotted line.

As shown in FIG. 12, an antenna 100A according to a second embodiment of the present invention is mountable on an object 800. The antenna 100A according to the second embodiment of the present invention has a structure similar to that of the antenna 100 according to the aforementioned first embodiment as shown in FIG. 1. Components of the antenna 100A shown in FIGS. 8 to 14 which are same as those of the antenna 100 of the first embodiment are referred by using reference signs same as those of the antenna 100 of the first embodiment. As for directions and orientations in the present embodiment, expressions same as those of the first embodiment will be used hereinbelow.

Figure 9:
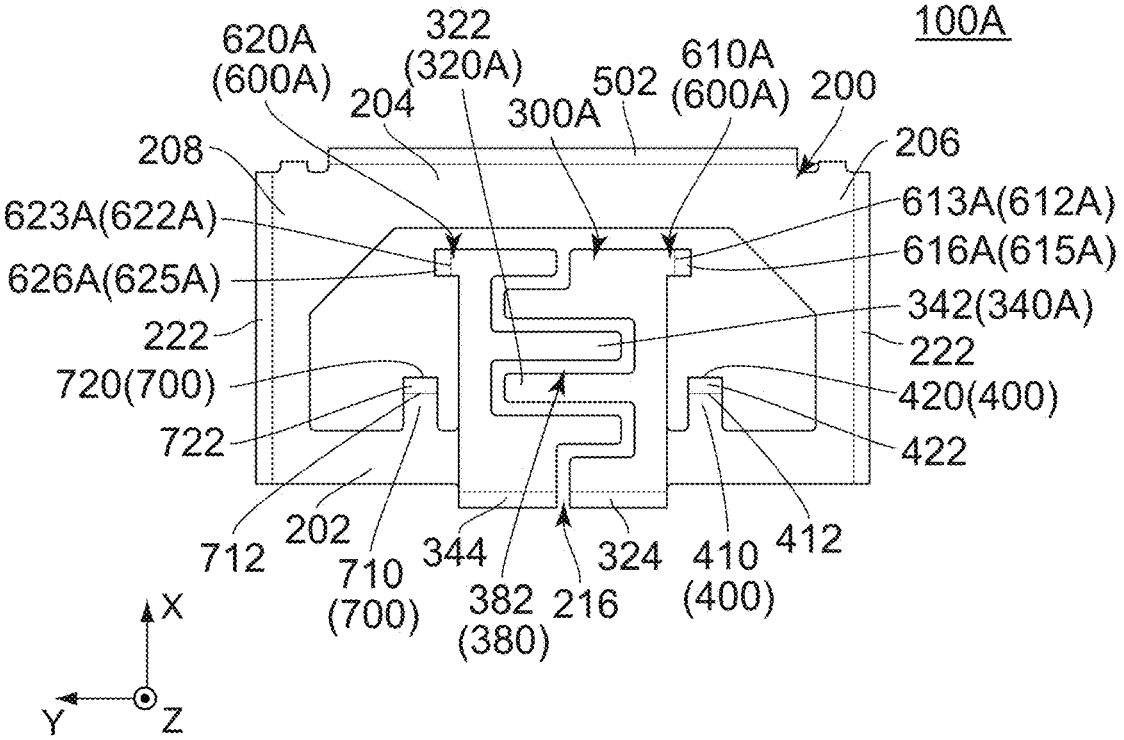
FIG. 9 is a top view showing the antenna of FIG. 8.
Figure 10:
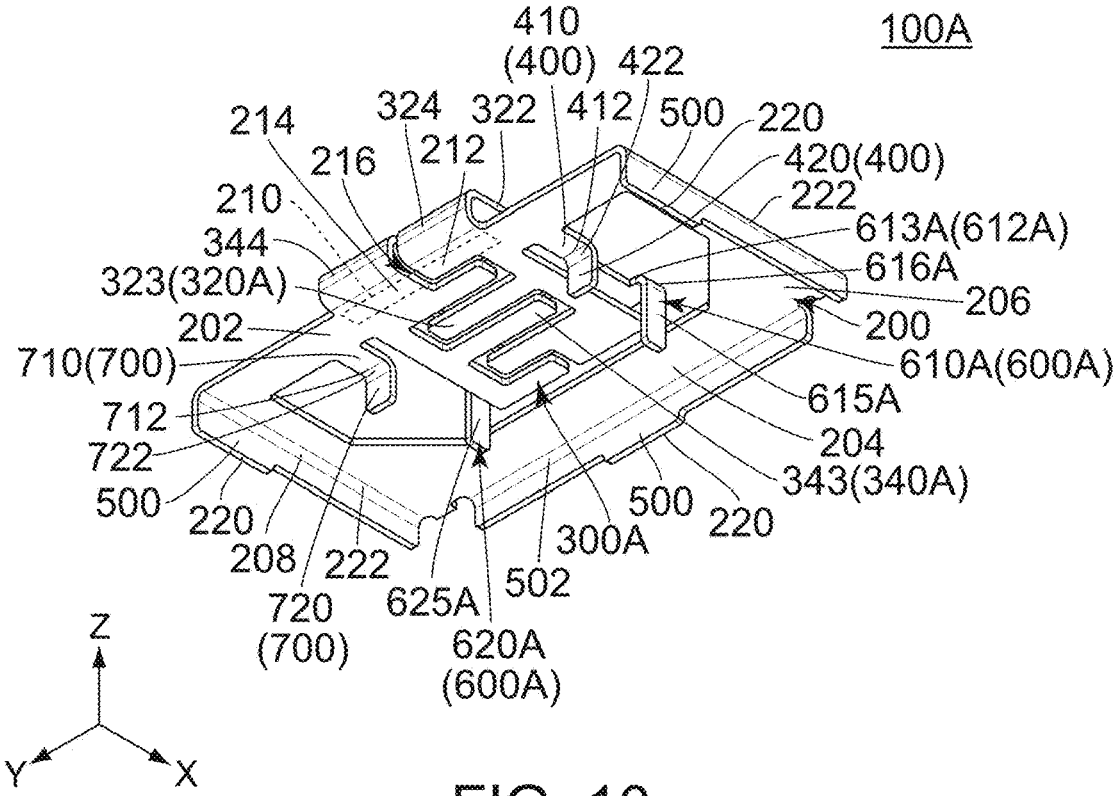
FIG. 10 is another perspective view showing the antenna of FIG. 8.

As shown in FIG. 9, the antenna 100A of the present embodiment is formed from a single metal plate which has a plurality of bent portions 222, 324, 344, 422, 502, 616A, 626A and 722. The antenna 100A of the present embodiment forms a split ring resonator. More specifically, as shown in FIG. 10, the antenna 100A of the present embodiment has a main portion 200, a facing portion 300A, a first feed terminal 400, three second feed terminals 500 and two reinforcing terminals 600A. However, the present invention is not limited thereto. The number of the second feed terminal 500 may be one or more. Similarly, the number of the reinforcing terminal 600A may be one or more. Components of the antenna 100A other than the facing portion 300A and the reinforcing terminal 600A have structures same as those of the antenna 100 of the first embodiment. Accordingly, a detailed explanation about the components other than the facing portion 300A and the reinforcing terminal 600A is omitted.

As understood from FIG. 9, the facing portion 300A of the present embodiment constitutes a capacitor of the antenna 100A. Similar to the aforementioned first embodiment, the main portion 200 of the present embodiment constitutes an inductance of the antenna 100A. Thus, the facing portion 300A and the main portion 200 form an LC resonator circuit. A rear end of the facing portion 300A is not coupled with the main portion 200. The facing portion 300A is positioned between sides 202 and 204 of the main portion 200 in the front-rear direction. The facing portion 300A is positioned between sides 206 and 208 of the main portion 200 in the right-left direction. The facing portion 300A includes a first facing portion 320A and a second facing portion 340A. Specifically, the first facing portion 320A is provided on a first end portion 212, and the second facing portion 340A is provided on a second end portion 214.

As shown in FIG. 9, the first facing portion 320A and the second facing portion 340A of the present embodiment are spaced away from each other and face each other. More specifically, in the right-left direction, the first facing portion 320A and the second facing portion 340A are spaced away from each other and face each other. The facing portion 300A is formed with an interdigital slot 380 between the first facing portion 320A and the second facing portion 340A.

Figure 8:
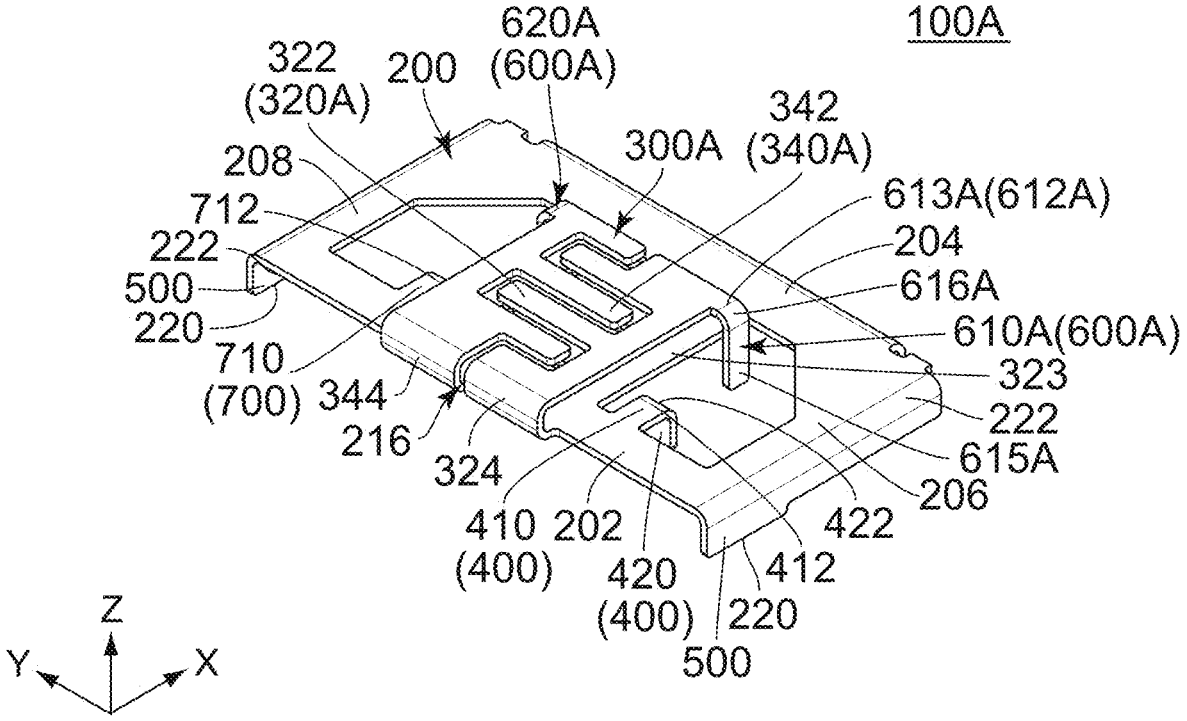
FIG. 8 is a perspective view showing an antenna according to a second embodiment of the present invention.

As shown in FIGS. 8 and 10, the first facing portion 320A of the present embodiment has a comb shape. The first facing portion 320A extends from the first end portion 212 to be positioned inward of the main portion 200. More specifically, the first facing portion 320A extends rearward in the front-rear direction from the first end portion 212 to be positioned inward of the main portion 200. A rear end of the first facing portion 320A is not coupled with the main portion 200. The first facing portion 320A is positioned left of the second facing portion 340A in the right-left direction.

As shown in FIGS. 8 and 10, the first facing portion 320A of the present embodiment consists of a first upper facing element 322, a first lower facing element 323 and a first facing portion bent portion (bent portion) 324.

As shown in FIG. 9, the first upper facing element 322 of the present embodiment has a comb shape. The first upper facing element 322 extends rearward in the front-rear direction from the first facing portion bent portion 324. A rear end of the first upper facing element 322 is not coupled with the main portion 200. As shown in FIG. 8, the first upper facing element 322 is positioned above the first lower facing element 323 in the up-down direction.

As shown in FIG. 11, the first lower facing element 323 of the present embodiment has a comb shape. The first lower facing element 323 extends from the first end portion 212 to be positioned inward of the main portion 200. More specifically, the first lower facing element 323 extends rearward in the front-rear direction from the first end portion 212 to be positioned inward of the main portion 200. A rear end of the first lower facing element 323 is not coupled with the main portion 200.

As understood from FIGS. 8 to 11, the first upper facing element 322 and the first lower facing element 323 overlap with each other when the antenna 100A is viewed along the up-down direction. More specifically, the first upper facing element 322 and the first lower facing element 323 completely overlap with each other when the antenna 100A is viewed along the up-down direction. In other words, one of the first upper facing element 322 and the first lower facing element 323 completely hides the other when the antenna 100A is viewed along the up-down direction.

Figure 13:
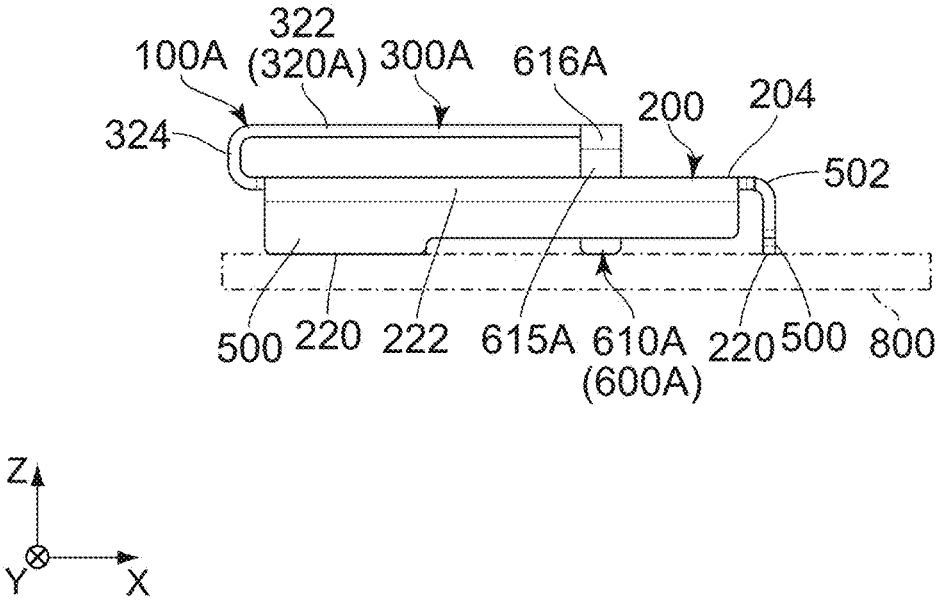
FIG. 13 is a side view showing the antenna of FIG. 8. In the figure, the object is illustrated by dotted line.

As shown in FIG. 13, the first facing portion bent portion 324 of the present embodiment has a sideways U cross-section in a plane perpendicular to the right-left direction. A front end of the first facing portion bent portion 324 is a front end of the antenna 100A. As shown in FIG. 10, the first facing portion bent portion 324 couples the first upper facing element 322 and the first end portion 212 with each other. As shown in FIG. 11, the first facing portion bent portion 324 is coupled with the first end portion 212 in the front-rear direction. As shown in FIG. 9, the first facing portion bent portion 324 is coupled with the first upper facing element 322 in the front-rear direction.

As shown in FIGS. 8 and 10, the second facing portion 340A of the present embodiment has a comb shape. The second facing portion 340A extends from the second end portion 214 to be positioned inward of the main portion 200. More specifically, the second facing portion 340A extends rearward in the front-rear direction from the second end portion 214 to be positioned inward of the main portion 200. A rear end of the second facing portion 340A is not coupled with the main portion 200. The second facing portion 340A is positioned right of the first facing portion 320A in the right-left direction.

As shown in FIGS. 8 and 10, the second facing portion 340A of the present embodiment consists of a second upper facing element 342, a second lower facing element 343 and a second facing portion bent portion (bent portion) 344.

As shown in FIG. 9, the second upper facing element 342 of the present embodiment has a comb shape. The second upper facing element 342 extends rearward in the front-rear direction from the second facing portion bent portion 344. A rear end of the second upper facing element 342 is not coupled with the main portion 200. As understood from FIGS. 8 and 10, the second upper facing element 342 is positioned above the second lower facing element 343 in the up-down direction.

As shown in FIG. 11, the second lower facing element 343 of the present embodiment has a comb shape. The second lower facing element 343 extends from the second end portion 214 to be positioned inward of the main portion 200. More specifically, the second lower facing element 343 extends rearward in the front-rear direction from the second end portion 214 to be positioned inward of the main portion 200. A rear end of the second lower facing element 343 is not coupled with the main portion 200.

As understood from FIGS. 8 to 11, the second upper facing element 342 and the second lower facing element 343 overlap with each other when the antenna 100A is viewed along the up-down direction. More specifically, the second upper facing element 342 and the second lower facing element 343 completely overlap with each other when the antenna 100A is viewed along the up-down direction. In other words, one of the second upper facing element 342 and the second lower facing element 343 completely hides the other when the antenna 100A is viewed along the up-down direction.

Referring to FIGS. 8 and 10, the second facing portion bent portion 344 of the present embodiment has a sideways U cross-section in the plane perpendicular to the right-left direction. A front end of the second facing portion bent portion 344 is the front end of the antenna 100A. As understood from FIGS. 8 and 10, the second facing portion bent portion 344 couples the second upper facing element 342 and the second end portion 214 with each other. As shown in FIG. 11, the second facing portion bent portion 344 is coupled with the second end portion 214 in the front-rear direction. As shown in FIG. 9, the second facing portion bent portion 344 is coupled with the second upper facing element 342 in the front-rear direction.

As shown in FIG. 9, the first upper facing element 322 and the second upper facing element 342 of the present embodiment are spaced away from each other and face each other. More specifically, in the right-left direction, the first upper facing element 322 and the second upper facing element 342 are spaced away from each other and face each other. The facing portion 300A is formed with an interdigital slot 382 between the first upper facing element 322 and the second upper facing element 342.

As shown in FIG. 11, the first lower facing element 323 and the second lower facing element 343 of the present embodiment are spaced away from each other and face each other. More specifically, in the right-left direction, the first lower facing element 323 and the second lower facing element 343 are spaced away from each other and face each other. The facing portion 300A is formed with an interdigital slot 384 between the first lower facing element 323 and the second lower facing element 343.

As described above, the facing portion 300A of the present embodiment includes a tier, which consists of the first upper facing element 322, the second upper facing element 342 and the interdigital slot 382, and another tier consisting of the first lower facing element 323, the second lower facing element 343 and the interdigital slot 384. In other words, the facing portion 300A of the present embodiment has a two-tier structure. This structure enables the capacitor of the antenna 100A to have an increased capacitance without increasing a size of the facing portion 300A in a plane perpendicular to the up-down direction. If the capacitor of the antenna 100A has an increased capacitance under a condition where the antenna 100A has a constant resonant frequency, the main portion 200 can have a reduced inductance. This means that the main portion 200A of the antenna 100A has a reduced size in the plane perpendicular to the up-down direction. In other words, the antenna 100A can occupy a reduced area on the object 800 upon mounting of the antenna 100A on the object 800.

Figure 14:
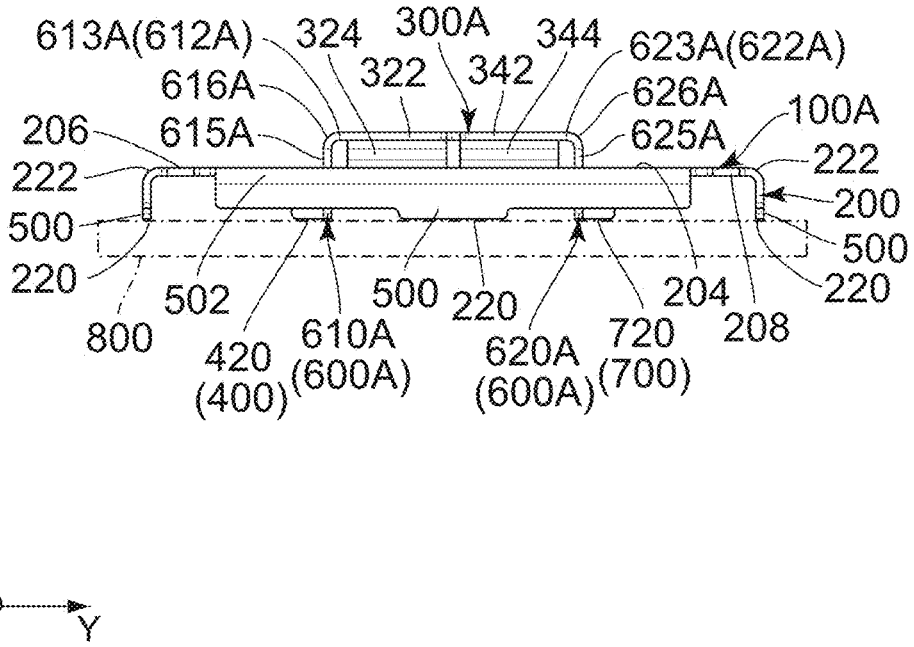
FIG. 14 is a rear view showing the antenna of FIG. 8. In the figure, the object is illustrated by dotted line.
Figure 15:
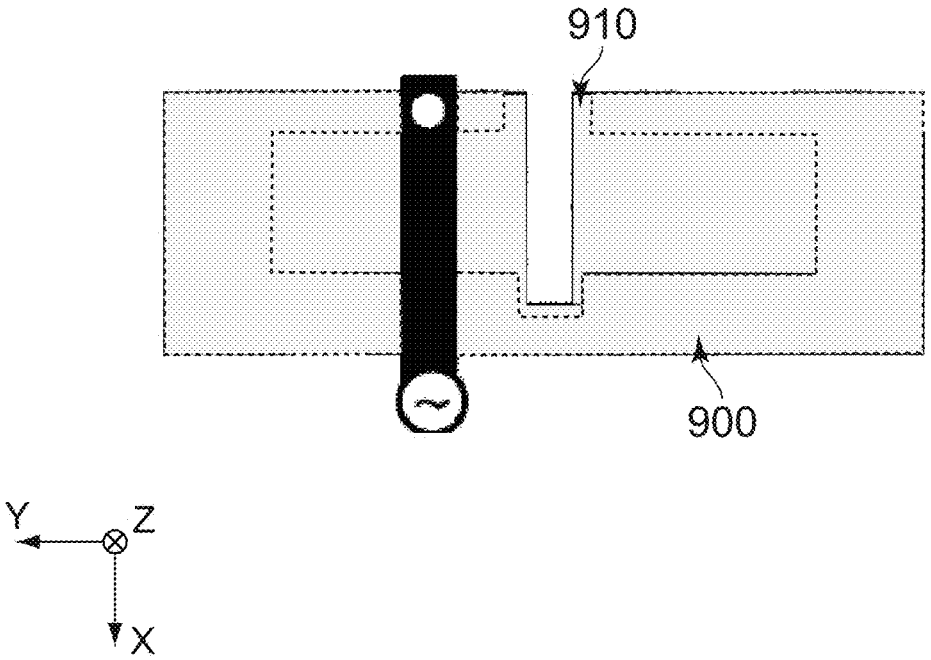
FIG. 15 PRIOR ART
FIG. 15 is a bottom view showing an antenna of Patent Document 1. In the figure, a conductive pattern of the antenna is illustrated by dotted line.
Figure 16:
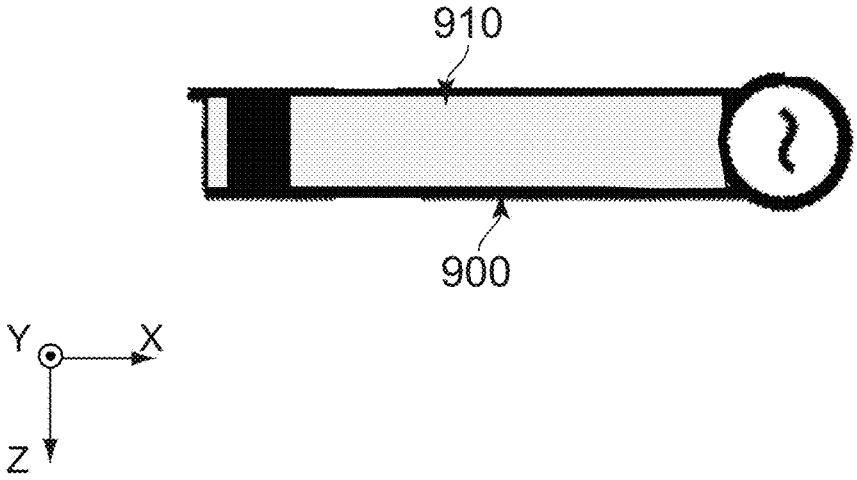
FIG. 16 PRIOR ART
FIG. 16 is a cross-sectional view showing the antenna of FIG. 15.

As shown in FIG. 14, each of the reinforcing terminals 600A of the present embodiment is fixed to the object 800 when the antenna 100A is mounted on the object 800. As shown in FIG. 8, each of the reinforcing terminals 600A extends from the facing portion 300A.

As shown in FIG. 11, the reinforcing terminal 600A is positioned away from a split line portion 210. More specifically, the reinforcing terminal 600A is positioned rearwardly away from the split line portion 210 in the front-rear direction. The reinforcing terminal 600A is positioned away from any of the first end portion 212 and the second end portion 214. More specifically, the reinforcing terminal 600A is positioned rearwardly away from any of the first end portion 212 and the second end portion 214 in the front-rear direction. The reinforcing terminal 600A is positioned away from the first feed terminal 400. More specifically, the reinforcing terminal 600A is positioned rearwardly away from the first feed terminal 400 in the front-rear direction. The reinforcing terminal 600A is positioned away from an additional terminal 700. More specifically, the reinforcing terminal 600A is positioned rearwardly away from the additional terminal 700 in the front-rear direction.

As shown in FIG. 11, the reinforcing terminal 600A is nearer to the rear end of the facing portion 300A than to the split line portion 210 in the front-rear direction. The reinforcing terminal 600A is nearer to the rear end of the facing portion 300A than to any of the first end portion 212 and the second end portion 214 in the front-rear direction. The reinforcing terminal 600A is nearer to the rear end of the facing portion 300A than to the first feed terminal 400 in the front-rear direction. The reinforcing terminal 600A is nearer to the rear end of the facing portion 300A than to the additional terminal 700 in the front-rear direction. Specifically, the reinforcing terminal 600A is positioned around the rear end of the facing portion 300A.

As shown in FIG. 11, the reinforcing terminal 600A is nearer to the side 204 of the main portion 200 than to the split line portion 210 in the front-rear direction. The reinforcing terminal 600A is nearer to the side 204 of the main portion 200 than to any of the first end portion 212 and the second end portion 214 in the front-rear direction. The reinforcing terminal 600A is nearer to the side 204 of the main portion 200 than to the first feed terminal 400 in the front-rear direction. The reinforcing terminal 600A is nearer to the side 204 of the main portion 200 than to the additional terminal 700 in the front-rear direction.

As shown in FIGS. 10 and 11, the reinforcing terminals 600A of the present embodiment include a first reinforcing terminal 610A and a second reinforcing terminal 620A.

As shown in FIGS. 10 and 11, the first reinforcing terminal 610A of the present embodiment extends from the first facing portion 320A. More specifically, the first reinforcing terminal 610A extends leftward from the first facing portion 320A and is then bent to extend downward. The first reinforcing terminal 610A is positioned left of the second reinforcing terminal 620A in the right-left direction.

As shown in FIGS. 10 and 11, the first reinforcing terminal 610A is positioned away from the split line portion 210. More specifically, the first reinforcing terminal 610A is positioned rearwardly away from the split line portion 210 in the front-rear direction. The first reinforcing terminal 610A is positioned away from the first end portion 212. More specifically, the first reinforcing terminal 610A is positioned rearwardly away from the first end portion 212 in the front-rear direction. The first reinforcing terminal 610A is positioned away from the first feed terminal 400. More specifically, the first reinforcing terminal 610A is positioned rearwardly away from the first feed terminal 400 in the front-rear direction.

As shown in FIG. 11, the first reinforcing terminal 610A is nearer to the rear end of the first facing portion 320A than to the split line portion 210 in the front-rear direction. The first reinforcing terminal 610A is nearer to the rear end of the first facing portion 320A than to the first end portion 212 in the front-rear direction. The first reinforcing terminal 610A is nearer to the rear end of the first facing portion 320A than to the first feed terminal 400 in the front-rear direction. Specifically, the first reinforcing terminal 610A is positioned around the rear end of the first facing portion 320A.

As shown in FIG. 11, the first reinforcing terminal 610A is nearer to the side 204 of the main portion 200 than to the split line portion 210 in the front-rear direction. The first reinforcing terminal 610A is nearer to the side 204 of the main portion 200 than to the first end portion 212 in the front-rear direction. The first reinforcing terminal 610A is nearer to the side 204 of the main portion 200 than to the first feed terminal 400 in the front-rear direction. The first reinforcing terminal 610A is nearer to the side 204 of the main portion 200 than to the additional terminal 700 in the front-rear direction.

As shown in FIG. 11, the first reinforcing terminal 610A of the present embodiment is directly coupled with the first upper facing element 322. The first reinforcing terminal 610A of the present embodiment is not directly coupled with the first lower facing element 323. Specifically, the first reinforcing terminal 610A is coupled with only the first upper facing element 322 which is positioned above the first lower facing element 323. The first reinforcing terminal 610A has a first connecting portion 612A and a second connecting portion 615A.

As shown in FIG. 8, the first connecting portion 612A of the present embodiment extends in a first outward direction, which is directed outward of the first upper facing element 322 and intersects with the front-rear direction, from the first upper facing element 322 of the first facing portion 320A. More specifically, the first connecting portion 612A extends leftward in the right-left direction from the first upper facing element 322 of the first facing portion 320A. The first connecting portion 612A has an end 613A in the first outward direction. The end 613A of the first connecting portion 612A is a left end of the first connecting portion 612A.

As shown in FIG. 14, the second connecting portion 615A of the present embodiment is fixed to the object 800 when the antenna 100A is mounted on the object 800. As shown in FIG. 10, the second connecting portion 615A extends in a direction, which intersects with both the first outward direction and the front-rear direction, from the end 613A of the first connecting portion 612A. More specifically, as shown in FIG. 8, the second connecting portion 615A extends downward in the up-down direction. The second connecting portion 615A has a first reinforcing terminal bent portion (bent portion) 616A at its upper end in the up-down direction. The first reinforcing terminal bent portion 616A of the second connecting portion 615A is coupled with the end 613A of the first connecting portion 612A.

As described above, the first reinforcing terminal 610A extends downward from the first upper facing element 322. With this structure, if an external force is applied to the first upper facing element 322 from above under a state where the antenna 100A is mounted on the object 800, the applied external force is received by the object 800 through the first reinforcing terminal 610A. Accordingly, the first upper facing element 322 is effectively prevented from being deformed.

As shown in FIGS. 10 and 11, the second reinforcing terminal 620A of the present embodiment extends from the second facing portion 340A. More specifically, the second reinforcing terminal 620A extends rightward from the second facing portion 340A and is then bent to extends downward. The second reinforcing terminal 620A is positioned right of the first reinforcing terminal 610A in the right-left direction.

As shown in FIG. 11, the second reinforcing terminal 620A is positioned away from the split line portion 210. More specifically, the second reinforcing terminal 620A is positioned rearwardly away from the split line portion 210 in the front-rear direction. The second reinforcing terminal 620A is positioned away from the second end portion 214. More specifically, the second reinforcing terminal 620A is positioned rearwardly away from the second end portion 214 in the front-rear direction. The second reinforcing terminal 620A is positioned away from the additional terminal 700. More specifically, the second reinforcing terminal 620A is positioned rearwardly away from the additional terminal 700 in the front-rear direction.

As shown in FIG. 11, the second reinforcing terminal 620A is nearer to the rear end of the second facing portion 340A than to the split line portion 210 in the front-rear direction. The second reinforcing terminal 620A is nearer to the rear end of the second facing portion 340A than to the second end portion 214 in the front-rear direction. The second reinforcing terminal 620A is nearer to the rear end of the second facing portion 340A than to the additional terminal 700 in the front-rear direction. Specifically, the second reinforcing terminal 620A is positioned around the rear end of the second facing portion 340A.

As shown in FIG. 11, the second reinforcing terminal 620A is nearer to the side 204 of the main portion 200 than to the split line portion 210 in the front-rear direction. The second reinforcing terminal 620A is nearer to the side 204 of the main portion 200 than to the second end portion 214 in the front-rear direction. The second reinforcing terminal 620A is nearer to the side 204 of the main portion 200 than to the additional terminal 700 in the front-rear direction.

As shown in FIG. 11, the second reinforcing terminal 620A of the present embodiment is directly coupled with the second upper facing element 342. The second reinforcing terminal 620A of the present embodiment is not directly coupled with the second lower facing element 343. Specifically, the second reinforcing terminal 620A is coupled with only the second upper facing element 342 which is positioned above the second lower facing element 343. The second reinforcing terminal 620A has a first connecting portion 622A and a second connecting portion 625A.

As shown in FIG. 9, the first connecting portion 622A of the present embodiment extends in a second outward direction, which is directed outward of the second upper facing element 342 and intersects with the front-rear direction, from the second upper facing element 342 of the second facing portion 340A. More specifically, the first connecting portion 622A extends rightward in the right-left direction from the second upper facing element 342 of the second facing portion 340A. The first connecting portion 622A has an end 623A in the second outward direction. The end 623A of the first connecting portion 622A is a right end of the first connecting portion 622A.

As shown in FIG. 14, the second connecting portion 625A of the present embodiment is fixed to the object 800 when the antenna 100A is mounted on the object 800. As understood from FIGS. 10 and 11, the second connecting portion 625A extends in a direction, which intersects with both the second outward direction and the front-rear direction, from the end 623A of the first connecting portion 622A. More specifically, the second connecting portion 625A extends downward in the up-down direction. As shown in FIG. 9, the second connecting portion 625A has a second reinforcing terminal bent portion (bent portion) 626A at its upper end in the up-down direction. The second reinforcing terminal bent portion 626A of the second connecting portion 625A is coupled with the end 623A of the first connecting portion 622A.

As described above, the second reinforcing terminal 620A extends downward from the second upper facing element 342. With this structure, if an external force is applied to the second upper facing element 342 from above under the state where the antenna 100A is mounted on the object 800, the applied external force is received by the object 800 through the second reinforcing terminal 620A. Accordingly, the second upper facing element 342 is effectively prevented from being deformed.

Although the specific explanation about the present invention is made above referring to the embodiments, the present invention is not limited thereto and is susceptible to various modifications and alternative forms.

Although the additional terminal 700 of the antenna 100, 100A of the aforementioned embodiments has the same structure as the first feed terminal 400, the present invention is not limited. The additional terminal 700 may have a shape and size different from the shape and size of the first feed terminal 400. The resonant frequency of the antenna 100, 100A can be changed by modifying one or more of the position, shape and size of the additional terminal 700. It is easier to design the antenna 100, 100A, which has a configuration so that the first feed terminal 400 and the additional terminal 700 have the same shape and size while an arrangement thereof is symmetrical relative to the facing portion 300, 300A, in comparison with a design of an antenna that does not have the aforementioned configuration. Accordingly, it is preferable for the antenna 100, 100A to have the aforementioned configuration.

Although the facing portion 300A of the antenna 100A of the aforementioned second embodiment has the two-tier structure, the present invention is not limited thereto. The facing portion 300A may have a three or more tier structure. Although the antenna 100A of the aforementioned second embodiment is configured so that the first upper facing element 322 is positioned above the first lower facing element 323 while the second upper facing element 342 is positioned above the second lower facing element 343, the present invention is not limited thereto. Specifically, the antenna 100A may be modified so that the first upper facing element 322 is positioned below the first lower facing element 323 while the second upper facing element 342 is positioned below the second lower facing element 343.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna mountable on an object, wherein:

the antenna has a main portion, a facing portion, a first feed terminal, a second feed terminal and at least one reinforcing terminal;

the main portion has a ring shape which includes a split line portion;

the split line portion extends in a predetermined direction;

the split line portion has a split, a first end portion and a second end portion;

the first end portion and the second end portion are positioned away from each other in the predetermined direction with the split left therebetween;

the facing portion includes a first facing portion and a second facing portion;

the first facing portion is provided on the first end portion;

the second facing portion is provided on the second end portion;

the first facing portion and the second facing portion are spaced away from each other and face each other;

each of the first feed terminal and the second feed terminal is provided on the main portion;

each of the first feed terminal and the second feed terminal is fixed to the object when the antenna is mounted on the object;

the at least one reinforcing terminal is positioned away from the split line portion;

the at least one reinforcing terminal extends from the facing portion;

the at least one reinforcing terminal is fixed to the object when the antenna is mounted on the object; and the antenna forms a split ring resonator.

2. The antenna as recited in claim 1, wherein:

the first facing portion extends from the first end portion to be positioned inward of the main portion; and the second facing portion extends from the second end portion to be positioned inward of the main portion.

3. The antenna as recited in claim 1, wherein:

the at least one reinforcing terminal includes a first reinforcing terminal and a second reinforcing terminal;

the first reinforcing terminal extends from the first facing portion; and the second reinforcing terminal extends from the second facing portion.

4. The antenna as recited in claim 1, wherein:

the main portion has a substantially rectangular ring shape with four sides; and the split line portion is provided on a specific one of the four sides.

5. The antenna as recited in claim 1, wherein:

the antenna further has an additional terminal;

the additional terminal is provided on the main portion;

the additional terminal is fixed to the object when the antenna is mounted on the object;

on the main portion, the additional terminal is nearer to the second end portion than to the second feed terminal; and on the main portion, the first feed terminal is nearer to the first end portion than to the second feed terminal.

6. The antenna as recited in claim 5, wherein a shortest distance between the additional terminal and the second facing portion is shorter than a shortest distance between the additional terminal and the second feed terminal.

7. The antenna as recited in claim 5, wherein:

the first feed terminal is positioned away from any of the first end portion and the first facing portion; and the additional terminal is positioned away from any of the second end portion and the second facing portion.

8. The antenna as recited in claim 7, wherein:

each of the first feed terminal and the additional terminal has a first portion and a second portion;

the first portion extends in an inward direction from the main portion;

the inward direction is directed inward of the main portion;

the inward direction intersects with the predetermined direction;

the first portion has an end in the inward direction;

the second portion extends in an intersecting direction from the end of the first portion;

the intersecting direction intersects with both the inward direction and the predetermined direction; and the second portion is fixed to the object when the antenna is mounted on the object.

9. The antenna as recited in claim 5, wherein:

the main portion has a substantially rectangular ring shape with four sides; and the split line portion is provided on a specific one of the four sides.

10. The antenna as recited in claim 9, wherein the additional terminal extends from the specific one of the four sides.

11. The antenna as recited in claim 1, wherein:

each of the first facing portion and the second facing portion has a comb shape; and the facing portion is formed with an interdigital slot between the first facing portion and the second facing portion.

12. The antenna as recited in claim 1, wherein the antenna is formed from a single metal plate which has a plurality of bent portions.

* * * * *